United States Patent [19]

Sweezey

[11] 4,065,103

[45] Dec. 27, 1977

[54] FENCE ATTACHMENT

[76] Inventor: Charles R. Sweezey, Rte. 4, Box 40, Piedmont, S.C. 29673

[21] Appl. No.: 671,681

[22] Filed: Mar. 29, 1976

[51] Int. Cl.[2] ..... E04H 17/00

[52] U.S. Cl. ..... 256/11

[58] Field of Search ..... 256/11, 54, 55, 69, 256/68; 403/398, 399, 363, 387; 52/758 C, 758 F

[56] References Cited

U.S. PATENT DOCUMENTS

| | | | |
|---|---|---|---|
| 1,489,068 | 4/1924 | Drake | 403/387 |
| 1,664,603 | 4/1928 | Farrington | 256/11 |
| 3,295,873 | 1/1967 | Attwood | 403/405 |
| 3,591,211 | 7/1971 | Richey | 403/409 |

*Primary Examiner*—Doris L. Troutman

*Attorney, Agent, or Firm*—Bailey, Dority & Flint

[57] ABSTRACT

An attachment is illustrated for extending an existing chain link fence accommodating same to the stringing of barbed wire thereabove. The attachment contemplates the use of a vertical angle extending as a base to be received upon a vertical post of the existing fence for carrying an upright member having barbed wire receiving and securing means thereon in such a way that the upper fence supports do not have to be removed for accommodating the attachment.

2 Claims, 3 Drawing Figures

FENCE ATTACHMENT

BACKGROUND OF THE INVENTION

A number of efforts have been made to provide an attachment for ready securement to an existing chain link fence for extending the upper portion thereof as by the addition of several strands of barbed wire. Such devices in general use are illustrated in U.S. Pat. Nos. 3,698,691 and 3,749,368. Such devices possess the disadvantage of requiring removal of the upper rail of the fence in order to be received thereon. This means substantially dismantling the existing fence prior to positioning the extension members thereon. U.S. Pat. No. 3,771,767 illustrates the use of flexible resilient wire support arms attached to the top rail of the fence.

It is an important object of this invention to provide an attachment which may be readily installed upon an existing chain link fence having a vertical post.

Another important object of the invention is to permit the installation of such an attachment without requiring the substantial dismantlement of the existing fence and without requiring welding procedures and the like for making the attachment.

Still another important object of the invention is to provide a simple, inexpensive attachment for use in stringing barbed wire about existing chain link fences.

BRIEF DESCRIPTION OF THE INVENTION

It has been found that an attachment may be provided for extending existing chain link fences having a vertical angle serving as a base and to which an upright member for carrying the barbed wire and the like is attached. A horizontal channel is positioned in each of the diverging legs of the vertical angle for readily receiving an arcuate shank carrying first and second abutments for securing the shank for positioning the vertical base member upon the post of the chain link fence. Thus, the extension may be readily secured upon the existing posts without the use of special welding procedures and without the necessity for removing the upper bracing members of an existing fence.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
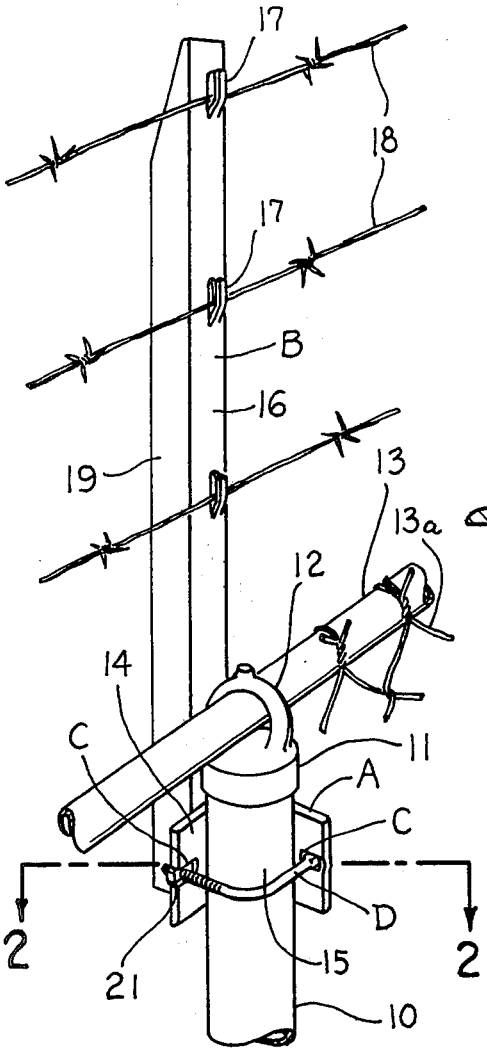
FIG. 1 is a perspective view illustrating a fence attachment constructed in accordance with the present invention secured upon a fence post of an existing chain link fence.

The drawing illustrates an attachment for use in stringing barbed wire and the like on existing chain link fences having vertical posts. A vertical angle A has diverging legs for receiving a vertical post therebetween. An upright member B extending above the fence has a web carrying barbed wire receiving and securing means thereon. A lower end of the upright member is integrally connected to the vertical angle adjacent a junction of the legs. A horizontal channel C is formed adjacent a free edge of each of the diverging legs of the vertical angle. An arcuate shank D extends through each of the channels. The shank is disposed horizontally and defines a bight for receiving the vertical post therewithin. A first abutment E is carried by the shank adjacent one end thereof exteriorly of one of the diverging legs. A second abutment F is threadably carried upon the shank exteriorly of the other of the diverging legs for securing the attachment tightly upon the vertical post.

A vertical post of an existing chain link fence is illustrated in the drawing at 10. The post 10 has a casting 11 carried by the top thereof with an arcuate bracket 12 thereon for receiving the upper fence bracing member 13 for stringing same between vertical fence posts. The wire of the chain link fence 13*a* normally extends about one inch above the top rail bracing 13.

The vertical angle A is illustrated as having diverging legs 14 and 15 for receiving the vertical post 10 therebetween. The upright member B is illustrated in the form of an angle having a web 16 carrying barbed wire receiving and securing means in the form of depressable gripping members 17 for securing the barbed wire strands 18 thereon. The upright member B also has a web 19 at right angles to the web 16 which is integrally secured as by welding at 20. The member B may be so secured as by welding when prefabricated in the plant so as not to require field welding.

Figure 2:
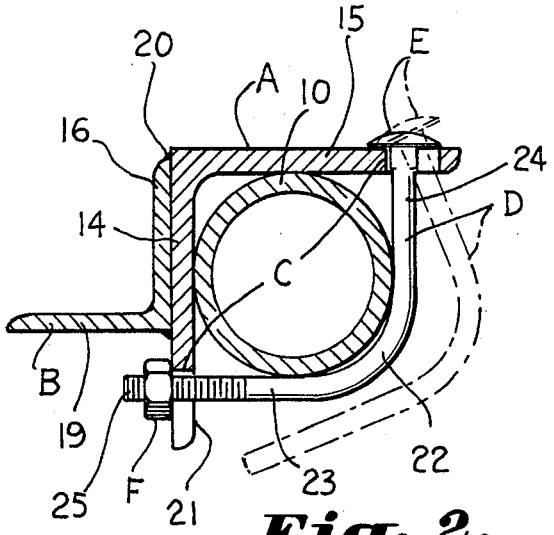
FIG. 2 is a sectional plan view taken on the line 2—2 in FIG. 1.

The horizontal channels C are formed adjacent a free edge of each of the diverging legs 14 and 15 and at least one of the channels opens at the side of a respective leg as illustrated at 21. The arcuate shank D is received within the horizontal channels which serve to adjust the attachment to accommodate fence posts of varying sizes while facilitating installation of the attachment on existing fences. As illustrated in FIG. 2, the shank B may be moved for installation from broken line position to solid line position to exactly fit and firmly secure the attachment upon the post. The shank D has an arcuate or substantially L-shaped bight 22 intermediate straight ends 23 and 24. A first abutment E is illustrated in the form of an integral head carried by the shank at the end of the straight portion 24. The other straight end portion 23 is exteriorly threaded as at 25 to receive an abutment F in the form of an internally threaded nut.

Figure 3:
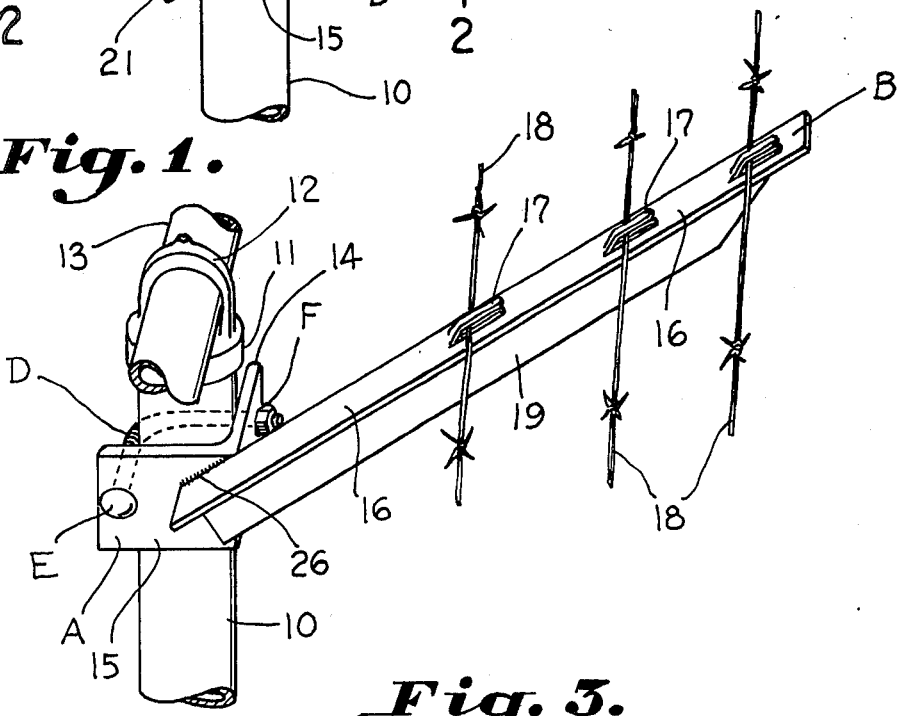
FIG. 3 is a perspective view illustrating a modified form of the invention.

FIG. 3, which illustrates a modified form of the invention, has like reference characters to designate like parts. It will be noted that the upright member B is inclined forwardly toward the exterior of the fence and that the web 19, rather than 16, is secured to the vertical angle leg 15 as by welding at 26.

While an upright member in the form of an intermediate or line attachment has been illustrated, it is to be understood that similar attachment may be used at corners or at changes in fence direction. Preferably, such corner attachments may be of somewhat sturdier construction since the major force in tightening the wire is exerted at the corner attachments. If desired, a pair of vertically spaced shank members may be employed, rather than the single shank illustrated for each attachment.

While a preferred embodiment of the invention has been described using specific terms, such description is for illustrative purposes only, and it is to be understood that changes and variations may be made without departing from the spirit or scope of the following claims.

What is claimed is:

1. An attachment for use in stringing barbed wire and the like on existing chain link fences having vertical posts comprising:

a vertical angle having diverging legs for receiving and engaging a vertical post therebetween;

an upright member, extending above the fence, having a web and a lower end integrally connected to said vertical angle adjacent a junction of said legs;

barbed wire receiving and securing means carried on said web;

a horizontal channel adjacent a free edge of each of said diverging legs of said vertical angle;

an arcuate shank extending through each of said channels, said shank being disposed horizontally and defining a bight for receiving said vertical post therewithin;

a first abutment carried by said shank adjacent one end thereof abutting the exterior of one of said diverging legs adjacent one of said channels for retaining said shank in said channel;

a second abutment threadably carried upon said shank adjacent the remote end thereof for abutting the exterior of the other of said diverging legs adjacent said other channel for securing the attachment tightly upon said vertical post; and said other channel being open at said free edge of its respective diverging leg for receiving said shank when pivoted in a generally horizontal movement about said first abutment.

2. The structure set forth in claim 1, wherein said upright member is an angle having diverging webs one of which carries said barbed wire receiving and securing means and the other being fixed to said vertical angle.

* * * * *